US006099050A

United States Patent [19]

Daoud

[11] Patent Number: 6,099,050

[45] Date of Patent: Aug. 8, 2000

[54] CAM-ACTUATED SECURITY OVERRIDE SYSTEM

[75] Inventor: Bassel Hage Daoud, Parsippany, N.J.

[73] Assignee: Lucent Technologies Inc., Murray Hill, N.J.

[21] Appl. No.: 09/264,792

[22] Filed: Mar. 9, 1999

[51] Int. Cl.[7] ..... E05C 19/08

[52] U.S. Cl. ..... 292/281; 292/140; 292/98; 292/341.15; 70/465; 70/159

[58] Field of Search ..... 292/246, 250, 292/100, 108, 140, 281, DIG. 65, 159, 111, 1, 98, 148, 138, 341.15, 341.17; 70/DIG. 63, 465, 2, 6, 159, 164

[56] References Cited

U.S. PATENT DOCUMENTS

| | | | |
|---|---|---|---|
| 748,202 | 12/1903 | Mills | 292/140 |
| 1,806,031 | 5/1931 | Vignos | 70/DIG. 63 |
| 1,961,041 | 5/1934 | Gilbert, Jr. | 292/148 |
| 2,405,240 | 8/1946 | Shearer et al. | 292/108 |
| 2,523,845 | 9/1950 | Roseburrough | 292/108 |
| 2,825,218 | 3/1958 | O'Brien | 70/7 |
| 3,397,906 | 8/1968 | Beckman et al. | 292/108 |
| 3,572,062 | 3/1971 | Beebe | 70/1.5 |
| 3,889,498 | 6/1975 | Harrell | 70/78 |
| 3,926,018 | 12/1975 | Joersz | 70/19 |
| 3,938,837 | 2/1976 | Bright | 292/149 |
| 4,085,599 | 4/1978 | Fischer et al. | 70/14 |
| 4,229,956 | 10/1980 | Thorburn | 70/129 |
| 4,290,281 | 9/1981 | Knaack et al. | 70/54 |
| 4,782,675 | 11/1988 | Thorburn | 70/129 |
| 5,076,078 | 12/1991 | Weger, Jr. | 70/54 |
| 5,092,143 | 3/1992 | Rumbles | 70/56 |
| 5,312,266 | 5/1994 | Daoud | 439/304 |
| 5,315,849 | 5/1994 | Georgopoulos | 70/34 |
| 5,484,177 | 1/1996 | Fortune et al. | 292/140 |
| 5,497,416 | 3/1996 | Butler, III et al. | 379/399 |
| 5,620,213 | 4/1997 | Ellis | 292/210 |
| 5,740,685 | 4/1998 | Daoud | 70/164 |
| 5,743,116 | 4/1998 | Suster | 70/14 |

*Primary Examiner*—Darnell M. Boucher
*Assistant Examiner*—John B. Walsh

[57] ABSTRACT

A security override system for a locked box comprising a hasp portion connected to a bracket slideably mounted within a locked box, the hasp portion extending through an opening in an outer door of the box; the bracket being movable between a closed position, wherein the hasp portion mates with the opening to form a padlock receiving portion, and an open position, wherein the hasp portion does not mate with the opening to enable the selective insertion and removal of a locked padlock in the padlock receiving portion without first unlocking the padlock; a cam member attached to the box and controllable from outside the box; the cam member comprising a pushing portion positioned and dimensioned to cooperate with a corresponding cutout in the bracket such that the bracket is movable between the open position and the closed position by the interaction of the cam member pushing portion with the cutout.

18 Claims, 6 Drawing Sheets

CAM-ACTUATED SECURITY OVERRIDE SYSTEM

FIELD OF THE INVENTION

This invention relates to a security system for use with a junction box, a Building Entrance Protector, or any other lockable enclosure or container, and in particular, to a cam-actuated security override system for permitting access to the enclosure when padlocked, without the need to unlock the padlock.

BACKGROUND OF THE INVENTION

Junction boxes have long been used to collect and protect telephone and electrical wires for distribution, splicing, cross connection and other uses. In the telephony arts, such wire junction boxes are more commonly known as network interface units (NIUs) and/or building entrance protectors (BEPs). Such containers are typically lockable In a telephone network, a network cable from the central office is connected to a BEP located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99 type connector block, such as are available from Lucent Technologies Inc. The customer telephone equipment is coupled through the connector block to a central office (CO) telephone line. The CO line side of the connector is generally the bottom side of the connector block, where the CO line tip-ring wire pairs are connected using a wire-wrapping tool.

The BEP generally has a lockable outer door to prevent unauthorized access to the components inside. The outer door is generally secured by a keyed or combination type padlock, and the building owner retains possession of the only key (or combination). Frequently, it is necessary for others in addition to the building owner to open the BEP for servicing or maintenance, for example, telephone company technicians or contractors acting in their capacity. Such servicing will at times occur during non-business hours or at other times when the building owner cannot be located or is not available. If the building owner is not available the technician wishing to service the BEP would not be able to do so because the building owner has the only key to the padlock. The technician would then have to come back at a later date when the building owner was available, which is both inconvenient to the technician, and costly to the building owner and their customers. Also, if the key or combination to the padlock was lost, it would be necessary to saw off the padlock in order to access the components within the BEP. Accordingly, a mechanism for overriding the padlock is desired, while at the same time maintaining the appearance of a secure, locked utility box.

SUMMARY OF THE INVENTION

The present invention provides a security override mechanism for accessing the components within a padlocked utility box without having to first unlock the padlock, while at the same time maintaining the appearance of a secure, locked utility box. The present invention, while described herein as preferably applied to such boxes as are used in the telephony arts, is, or will be seen from the disclosure herein, applicable to any lockable box, container, enclosure, or door thereof.

The mechanism consists of a slideable bracket having a generally U-shaped hasp portion at one end thereof. The bracket is slideably mounted to the inside of the utility box, and the hasp portion extends through an opening in the outer door of the utility box. The bracket/hasp is slideable between a closed position and an open position. The bracket has two oval cutouts to accept two corresponding guide bolts which are attached to the inside surface of the utility box. The bracket also has a quarter-circle cutout at the approximate longitudinal center thereof. The bracket/hasp portion is guided between its open and closed positions by the interaction of the guide bolts and the corresponding oval cutouts.

A security screw, for example a KS/216 screw, is mounted on a wall of the utility box. The screw comprises a head portion, which is accessible from outside the utility box, a shaft portion and a threaded portion. The screw extends through an opening in the utility box and through the quarter-circle cutout in the bracket. A cam is attached to the back side of the security screw within the quarter circle cutout. The cam is held in place within the cutout by attaching a locking nut to the threaded portion of the security screw. The shaft portion of the security screw is constructed to engage the cam such that the cam can be turned by turning the security screw, such as, for example, by providing a square-shaped shaft portion and a corresponding square-shaped opening in the cam. Thus, the cam can be pivoted within the cutout by turning the security screw from outside the utility box. The cam comprises a pushing portion at the end opposite to the end attached to the security screw, and a pin and cap member proximate the pushing portion.

By turning the security screw, the cam is pivoted around within the quarter-circle cutout and the pushing portion pivots against the inner surface of the perimeter of the cutout so as to push the bracket/hasp between its open position and closed position. A spring is attached between the pin proximate the pushing portion of the cam, at one end, and a fixed position within the utility box at the other end. The spring biases the cam such that the hasp portion is biased in either the open position or in the closed position. That is, when the hasp is in its open position, the spring biases the pushing portion of the cam against the bracket in such a way as to bias the hasp towards its open position. Similarly, when the hasp is in its closed position, the spring biases the pushing portion of the cam against the bracket in such a way as to bias the hasp towards its closed position. When the bracket/hasp is in its open position, there is a gap between the hasp portion and the outer door such that a locked padlock can pass between them for removal.

In normal use, when the hasp portion is in its closed position, it mates with the outer door to form an opening to receive an unlocked padlock. Thus, when the outer door is closed and the hasp portion is in its closed position mating with the outer door, an unlocked padlock may be inserted through the opening and locked, preventing the door from opening. When the hasp portion is in its closed position and the padlock is installed, it would appear as though the outer door cannot be opened without first unlocking and removing the padlock.

By turning the security screw, however, the cam forces the bracket to slide such that the hasp moves between the closed and open positions. Thus, by turning the security screw in one direction, the cam forces the bracket in one direction whereupon the hasp portion becomes separated from the outer door, such that a locked padlock can be removed and the outer door can be opened without first unlocking the padlock. By turning the security screw in the opposite direction, the cam forces the bracket in the opposite direction, such that the outer door can only be opened by unlocking and removing the padlock (or cutting the padlock off). Thus, while the utility box looks as though it cannot be opened without unlocking the padlock, the technician or other authorized user knowledgeable in its construction can open the utility box without first unlocking the padlock. Also, should the key to the padlock become lost, the building owner can open the utility box without having to cut off the padlock.

In a preferred embodiment, the utility box is also provided with a latching button which allows the outer door to automatically latch itself in the closed position when the outer door is closed. The latching button is installed in an opening in a side wall of the utility box. In a preferred embodiment the outer door has a latch member which is designed and positioned to correspond with an oppositely facing latch member on side wall. That is, when the outer door is in its closed position, the latch member on the outer door engages the latching member on the side wall of the utility box to maintain the outer door in its closed position. To disengage the outer door latch member from the side wall latching member, a user depresses inward on the latching button which in turn pushes the outer door latch member a sufficient distance to unlatch the outer door latch member from the side wall latch member. Once latching button has been depressed a sufficient distance, the outer door can be opened.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

DESCRIPTION OF THE DRAWING FIGURES

In the drawing figures, which are not to scale, and which are merely illustrative, and wherein like reference numerals depict like elements throughout the several views.

DETAILED DESCRIPTION OF THE PREFERRED EMBODIMENTS

Figure 3:
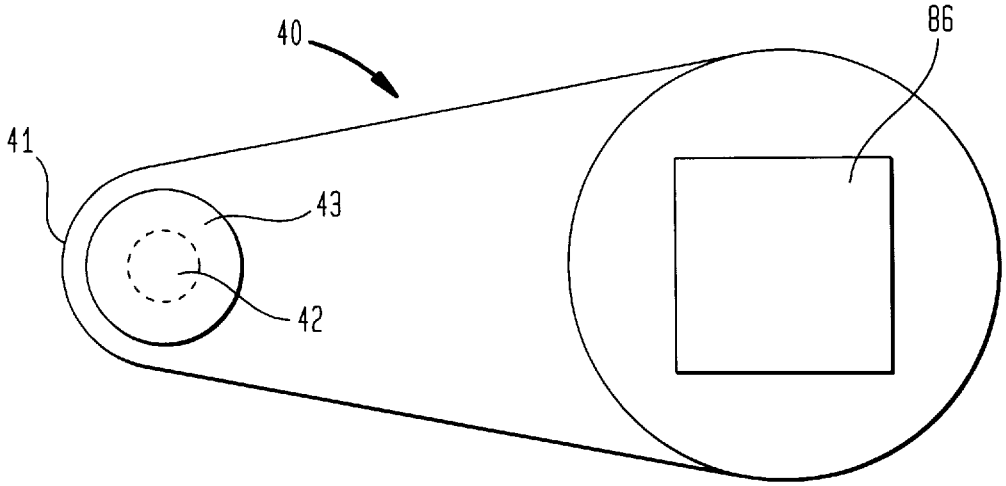
FIG. 3 is a top plan view of a cam constructed in accordance with a preferred embodiment of the present invention.
Figure 4:
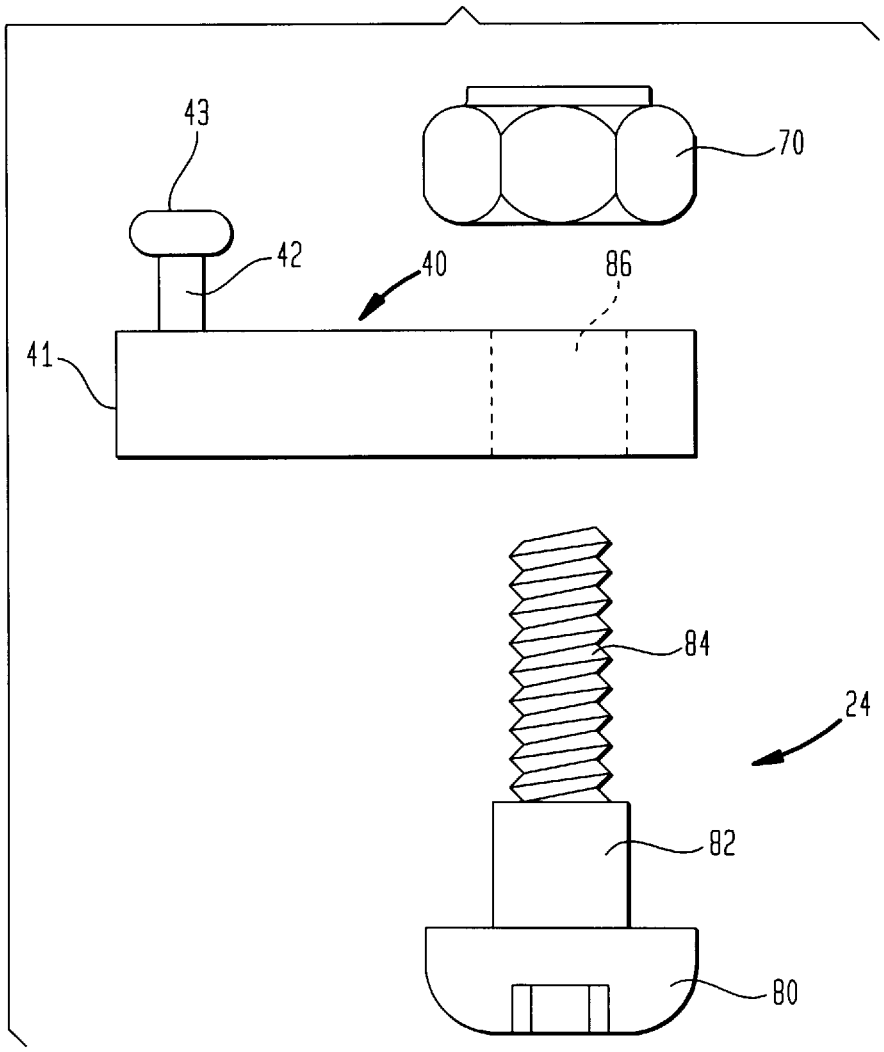
FIG. 4 is a side view of the cam of FIG. 3 shown relative to the related slideable bracket and also depicts a side view of a security screw and corresponding locking nut constructed in accordance with a preferred embodiment of the present invention.
Figure 5:
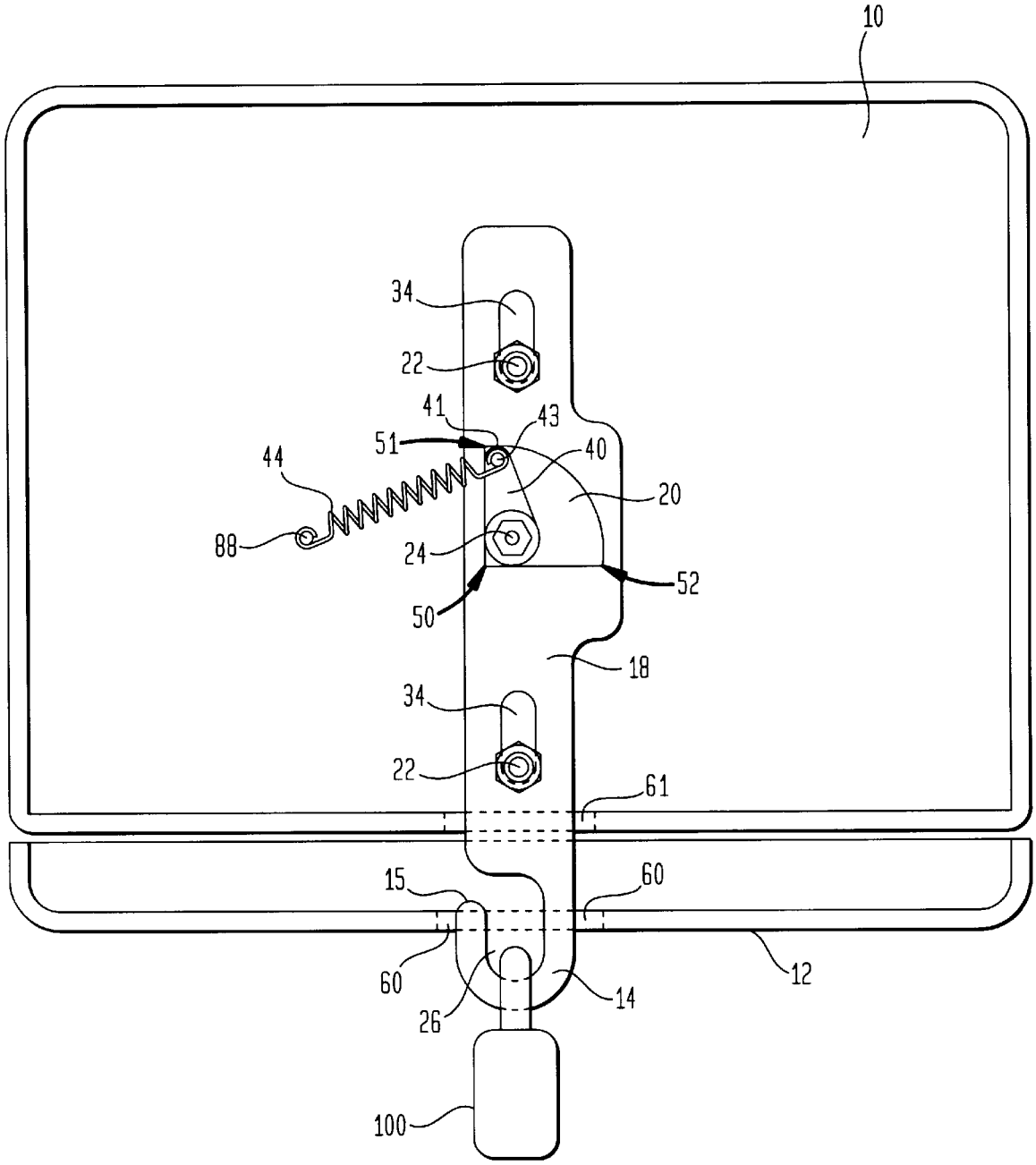
FIG. 5 is a side view of the cam-actuated security override system constructed in accordance with a preferred embodiment of the present invention mounted within a utility box and with the system in its closed position.
Figure 6:
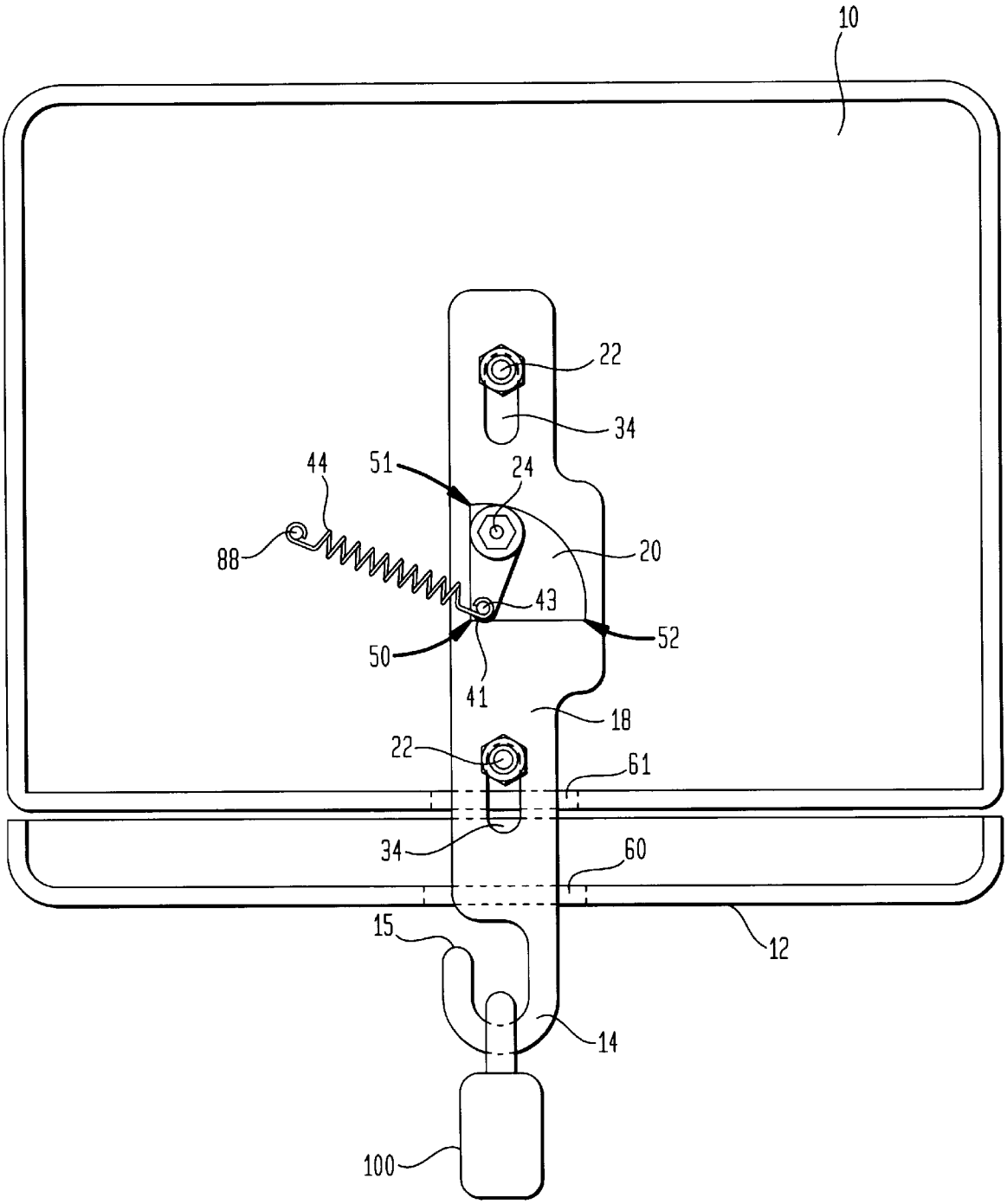
FIG. 6 is a side view of the cam-actuated security override system constructed in accordance with a preferred embodiment of the present invention mounted within a utility box and with the system in its open position.

FIGS. 1 through 6 depict a cam-actuated security override system constructed according to a preferred embodiment of the present invention. The security override system generally includes a bracket 18 slideably mounted within a utility box 10. The bracket comprises a generally U-shaped hasp portion 14 at one end thereof (FIGS. 5 and 6). Hasp portion 14 extends through an opening 61 in utility box 10 and an opening 60 in outer door 12 of utility box 10. Hasp portion 14 is constructed to mate with opening 60 in outer door 12 of utility box 10. The slideable hasp/bracket is movable between a closed position (FIG. 5) and an open position (FIG. 6) with respect to the outer door 12. That is, when slideable hasp portion 14 is in its closed position it mates with the opening 60 in outer door 12 and forms a padlock receiving section 26 therebetween (FIG. 5), giving the impression of a conventional padlock hasp. When slideable hasp portion 14 is in its open position, the free end 15 of hasp portion 14 no longer mates with opening 60 and there is a space between free end 15 and outer door 12 such that a locked padlock 100 can be passed therebetween (FIG. 6). The bracket/hasp and utility box can be constructed of any number of materials, such as, by way of a non-limiting example, metal or plastic, or any other material having the necessary rigidity and strength characteristics to fulfill the functions described herein.

As seen in FIGS. 1–6, hasp portion 14 forms a part of bracket 18 at one end thereof. Bracket 18 is slideably mounted to an inside wall 11 of utility box 10, and hasp portion 14 extends through opening 60 in outer door 12 of utility box 10. Bracket 18 has two oval cutouts 34 to accept two corresponding guide bolts 22 which are attached to inside wall 11. The bracket 18, and corresponding hasp portion 14, is guidedly moved between its open and closed positions by the interaction of guide bolts 22 and the corresponding oval cutouts 34. It will be appreciated by one skilled in the art that the shape of the hasp and bracket could be varied as a matter of design choice without departing from the spirit of the invention. Further, the guiding of the bracket from its closed to open position could be accomplished in any number of ways without departing from the spirit of the invention. Thus, for example, the guided movement of bracket 18 may be achieved in other art-recognize manners, such as via guide channels or rails or the like.

As seen in FIGS. 5 and 6, bracket 18 also has a quarter-circle cutout 20 oriented between the two oval cutouts 34. A security screw 24, by way of a non-limiting example a KS/216 screw, is mounted through wall 11 of utility box 10. As seen in FIG. 4, security screw 24 comprises a head portion 80, a shaft portion 82 and a threaded portion 84. Security screw 24 extends through an opening 62 in wall 11 and through quarter-circle cutout 20 in bracket 18. A cam, generally depicted as 40, is attached to security screw 24 within quarter-circle cutout 20 on the inside of utility box 10. A lock nut 70 is positioned on the back side of bracket 18 for maintaining security screw 24 on box 10 and for maintaining cam 40 within quarter-circle cutout 20. Shaft portion 82 of security screw 24 is constructed to engage cam 40 such that the cam can be turned by turning the security screw.

As seen in FIGS. 3 and 4, in a preferred embodiment, shaft portion 82 is square-shaped to correspond with square-shaped opening 86 in cam 40. Thus, cam 40 can be pivoted within cutout 20 by turning security screw 24 from outside utility box 10. The shape of shaft portion 82 and the corresponding opening in cam 40 can be any number of shapes without departing from the spirit of the present invention. That is, one of skill in the art will recognize that the engagement of security screw 24 with cam 40 can be accomplished in any number of art-recognized ways, such as, for example, by providing a keyway, slot, gears or the like in screw 24 and opening 86. Cam 40 also comprises a pushing portion 41 at the end opposite to the end attached to security screw 24, and a pin 42 and cap member 43 proximate the pushing portion 41. In a preferred embodiment, cam 40 is a generally elongated oval shape, with one end being smaller than the other. One of skill in the art will recognize however that the cam member can be constructed in any number of shapes without departing from the spirit of the invention.

As best seen in FIGS. 5 and 6, cam 40 is constructed to be positioned within quarter-circle cutout 20 in bracket 18. By turning security screw 24, shaft portion 82 engages hole 86 and cam 40 is pivoted about security screw 24 within quarter-circle cutout 20. A spring 44 is attached to pin 42 at one end, and to utility box 10 by securement means 88 at the other end. Cap member 43 maintains the connection of spring 44 to cam 40. As more fully described below, spring 44 biases pushing portion 41 of cam 40 in such a way as to bias hasp portion 14 in both its open position and its closed position. Also, as described more fully below, security screw 24 can be turned in one direction to move hasp portion 14 to its open position, and security screw 24 can be turned in other direction to move hasp portion 14 to its closed position. Security screw 24 is preferably any type of screw that requires a non-standard tool to operate, although any standard art-recognized screw or bolt may be utilized. One skilled in the art will recognize that security screw 24 and cam 40, which act as the means for movement of bracket 18, could be constructed in a variety of shapes and sizes and mechanisms to facilitate controlled movement of bracket 18 from outside utility box 10 without departing from the spirit of the invention, such as, for example, through the use of other types of bolts known in the art, gears, locks, keyed cylinders, barrel locks, or the like.

As seen in FIG. 5, when outer door 12 is closed and hasp portion 14 is in its closed position mating with opening 60 in outer door 12, an unlocked padlock 100 can be inserted through padlock receiving section 26 formed thereby and thereafter locked. The locked padlock 100 is therefore between outer door 12 and the mating hasp portion 14, thus preventing outer door 12 from opening. Thus, when hasp portion 14 is in its closed position and the locked padlock 100 is installed in padlock receiving section 26, it would appear as though outer door 12 cannot be opened without first unlocking and removing the padlock 100. Of course, outer door 12 could be opened by unlocking and removing the padlock 100 without having to loosen security screw 24. However, as shown in FIG. 4, the security mechanism can be overridden by the technician or building owner by turning security screw 24, which in turn pivots cam 40 within cutout 20, whereby pushing portion 41 moves bracket 18 and hasp portion 14 to its open position, and wherein the locked padlock 100 can be passed through the opening between the free end 15 of hasp portion 14 and outer door 12.

Figure 1:
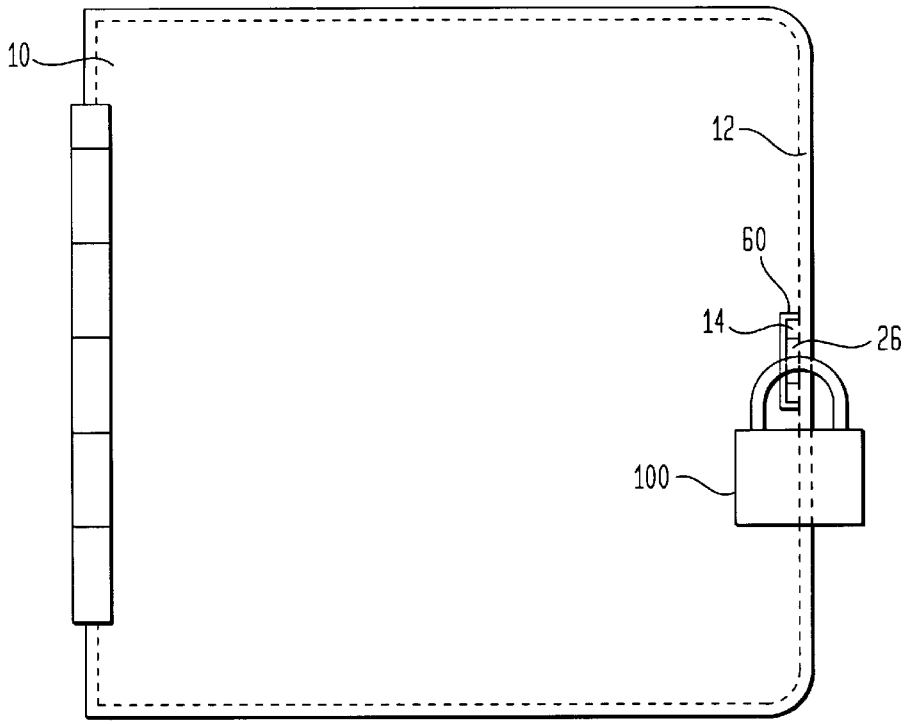
FIG. 1 is a front elevational view of the cam-actuated security override system constructed in accordance with a preferred embodiment of the present invention mounted to a utility box and with the system in its closed position.
Figure 2:
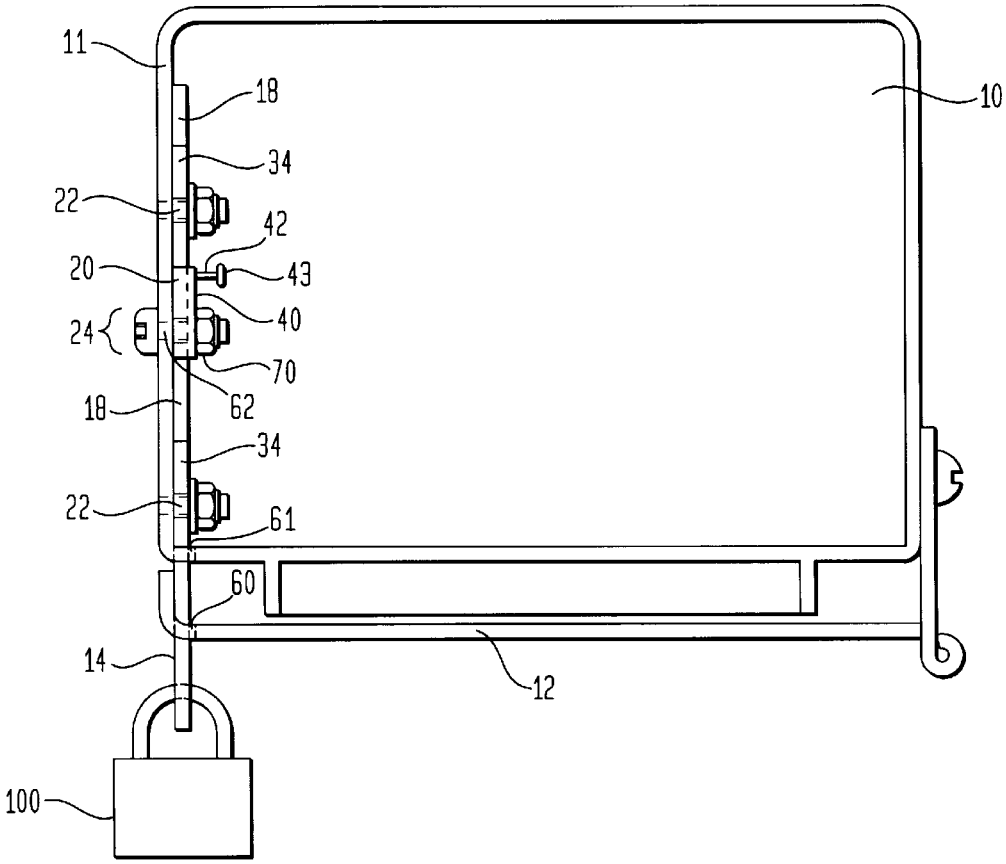
FIG. 2 is a top view of the cam-actuated security override system depicted in FIG. 1 with the lock rotated 90 degrees for illustration clarity.

As seen in FIG. 2, security screw 24 can be accessed and turned from outside utility box 10. As seen in FIG. 3, security screw 24 extends within utility box 10, and through quarter-circle cutout 20 of bracket 18. As seen in FIGS. 5 and 6, quarter-circle cutout 20 generally comprises three corner sections, namely, a right angled corner 50, an arced corner 51, and an arced corner 52. Quarter-circle cutout 20 is designed to correspond to the arc of pushing portion 41 of cam 40. That is, the quarter-circle arc between arced corner 51 and arced corner 52 corresponds to the radial range of pushing portion 41 of cam 40 about security screw 24.

As seen in FIG. 5, when hasp portion 14 is in its closed position, security screw 24 is generally positioned in the right angled corner 50 of cutout 20 with pushing portion 41 generally positioned in arced corner 51. By turning security screw 24 in a clockwise direction, pushing portion 41 is pivoted about security screw 24 along the arc between arced corner 51 and arced corner 52. One of skill in the art will recognize that during this initial turning of security screw 24, bracket 18 is not generally moved towards its open position. However, as security screw 24 is turned further, pushing portion 41 enters arced corner 52, and thereafter pushing portion 41 begins to push against arced corner 52, which in turn moves bracket 18 towards its open position. Bracket 18 is guided towards its open position by the interaction of guide bolts 22 and oval cutouts 34. Pushing portion 41 continues to push bracket 18 towards its open position until security screw 24 has been turned a sufficient distance such that pushing portion 41 begins to slide across cutout 20 from arced corner 52 towards corner 50. As seen in FIG. 6, when pushing portion 41 enters corner 50, security screw 24 cannot be turned further because the interaction of guide bolts 22 and oval cutouts 34 will not permit bracket 18 to move in that direction. Thus, by turning security screw 24 generally about 180 degrees, bracket 18 is moved a distance of about two times the radius of quarter-circle cutout 20. To move bracket 18 to its closed position, the process is reversed. That is, by turning security screw 24 in a counter-clockwise direction, pushing portion 41 is moved from corner 50, to corner 52, and then to corner 51, thus moving bracket 18 and hasp portion 14 to their closed position.

As seen in FIGS. 5 and 6, a spring 44 is attached between the utility box 10 by securement means 88 and pin 42, which is attached proximate to pushing portion 41 of cam 40. Spring 44 biases pushing portion 41 of cam 40 such that bracket 18 is biased in both the open position and closed position. That is, as seen in FIG. 5, when hasp portion 14 is in its closed position, spring 44 biases pushing portion 41 into corner 51. As stated above, because of the interaction of guide bolts 22 and oval cutouts 34, bracket 18 cannot generally move in the biased direction. Thus, spring 44 biases pushing portion 41 into corner 51, which thereby prevents bracket 18 from moving without turning security screw 24. As seen in FIG. 6, when hasp portion 14 is in its open position, spring 44 biases pushing portion 41 into corner 50. As stated above, because of the interaction of guide bolts 22 and oval cutouts 34, bracket 18 cannot move in the biased direction. Thus, spring 44 biases pushing portion 41 into corner 50 which in turn prevents bracket 18 from moving without turning security screw 24. One of skill in the art will recognize that the biasing of cam 40 can be achieved in any number of art-recognized fashions as a matter of design choice without departing from the spirit of the invention.

Thus, bracket 18, and hasp portion 14, is movable between an open position and a closed position by turning security screw 24. When security screw 24 is turned in a clockwise direction, pushing portion 41 of cam 40 moves bracket 18 to its open position. Thus, although spring 44 biases bracket 18 and hasp portion 14 to their respective closed positions, when security screw 24 is turned clockwise, the hasp portion 14 is moved to its open position and the technician can remove the locked padlock 100 and open outer door 12. When security screw 24 is turned in the counter-clockwise direction, pushing portion 41 moves bracket 18 towards its closed position such that outer door 12 can only be opened by first unlocking and removing the padlock 100 (or cutting the padlock off).

Thus, while utility box 10 looks as though it cannot be opened without first unlocking the padlock 100, the technician knowledgeable in its construction can open outer door 12 without first unlocking the padlock. Also, should the key to the padlock become lost, the building owner can open the utility box without having to cut off the padlock. It will be appreciated to one skilled in the art that the placement and type of security screw used is merely a matter of design choice and that alternate placement or types of screws or other devices does not depart from the spirit of the present invention. It will also be appreciated to one skilled in the art that to the ordinary observer that the security screw would not appear to serve any function in the opening of the utility box. That is, it would not be apparent to the ordinary observer that the security screw could be used to open a locked utility box.

Figure 7:
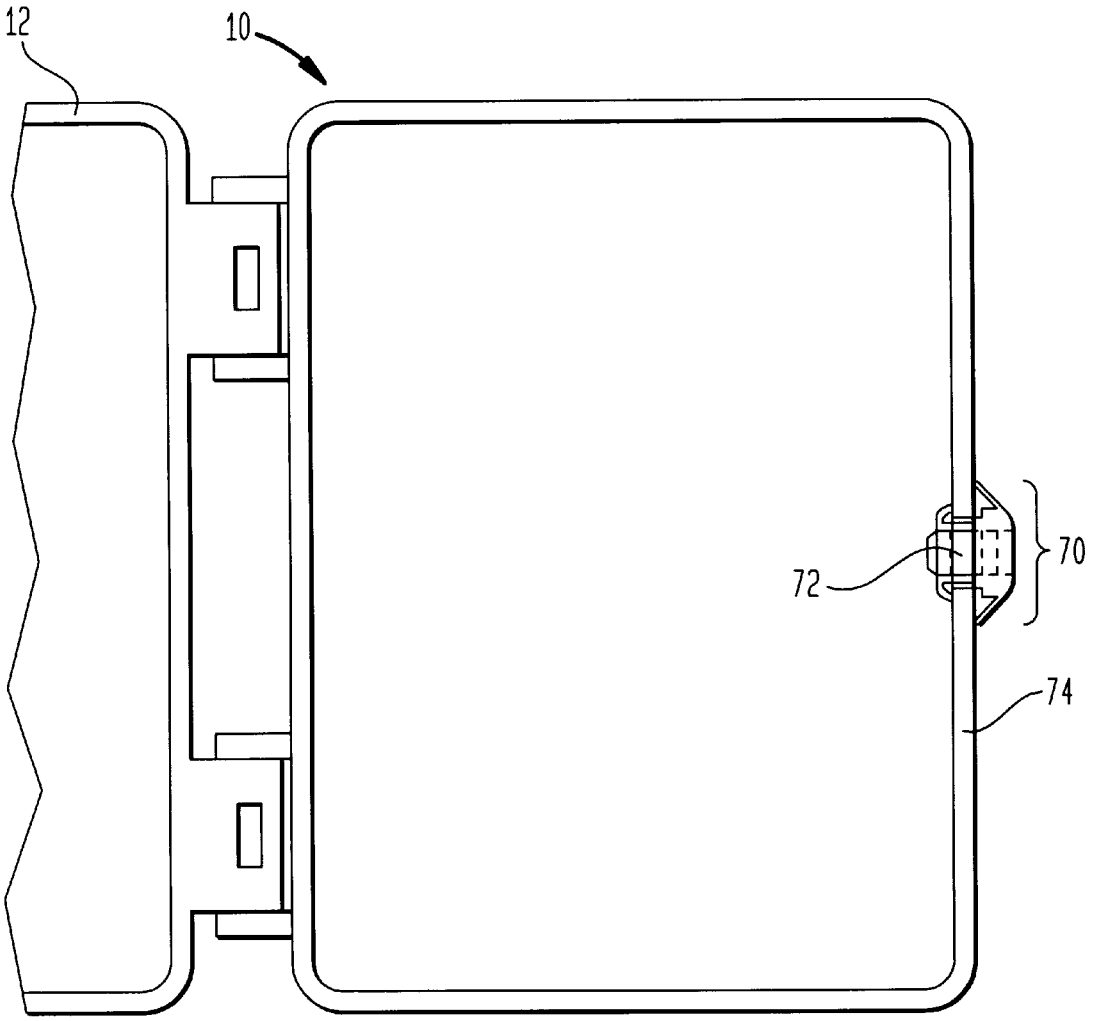
FIG. 7 is a front elevational view of a latching button installed in the side wall of a utility box constructed in accordance with a preferred embodiment of the present invention.
Figure 8:
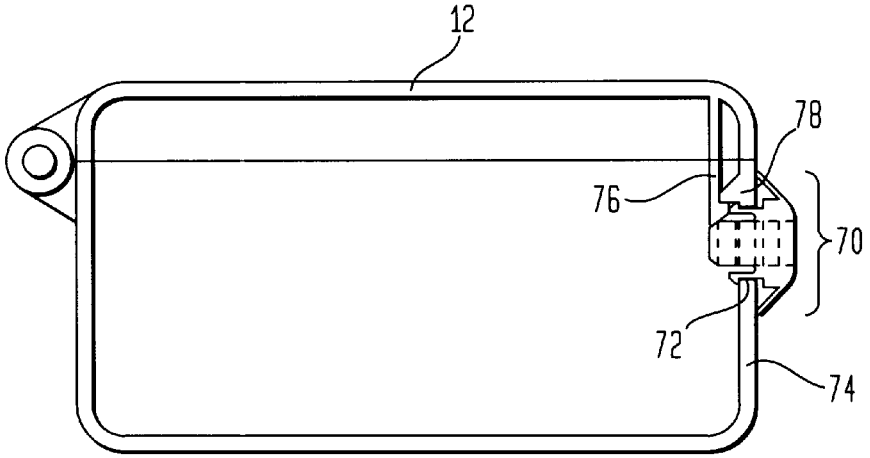
FIG. 8 is a bottom cutaway view of FIG. 7.
Figure 10:
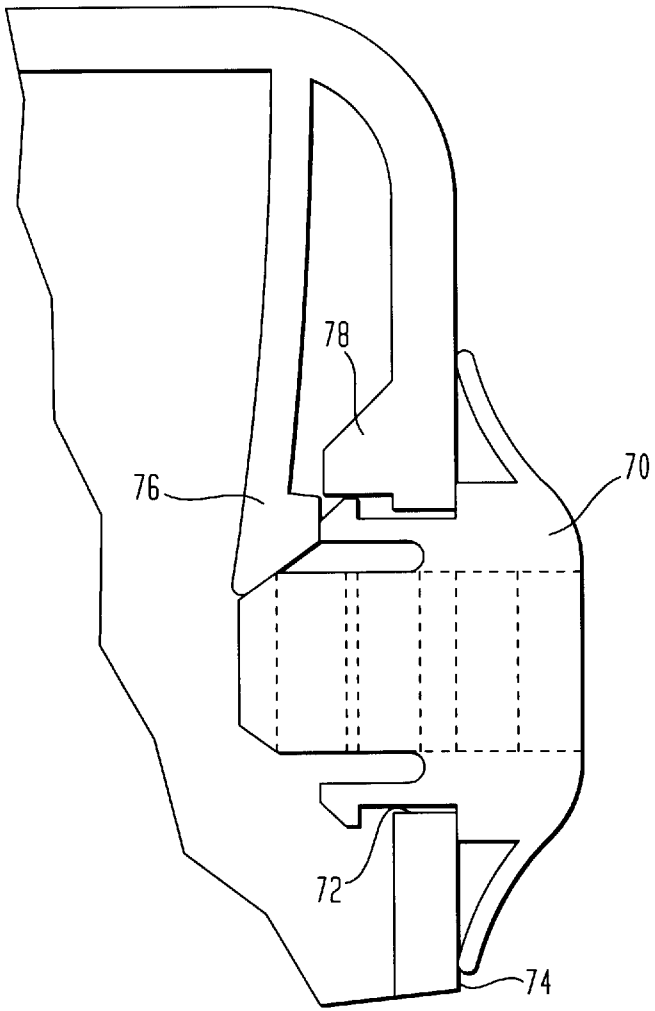
FIG. 10 is a detail view of the latching button of FIG. 8 with the latching button in its depressed state.
Figure 9:
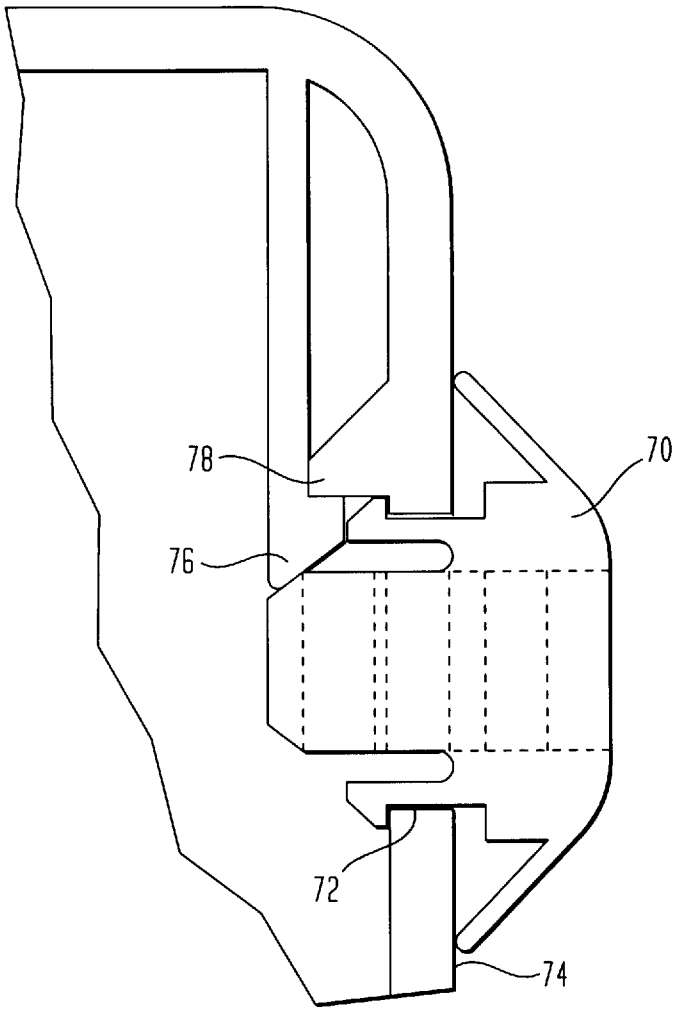
FIG. 9 is a detail view of the latching button of FIG. 8.

In a preferred embodiment, as seen in FIGS. 7–10, utility box 10 is also provided with a latching button, generally indicated as 70. Latching button 70 allows the outer door 12 to automatically latch itself in the closed position when the outer door 12 is closed. As seen in FIG. 7, latching button 70 is installed in an opening 72 in a side wall 74 of utility box 10. As seen in FIG. 8, outer door 12 has a latch member 76 which is designed and positioned to correspond with an oppositely facing latch member 78 on side wall 74. That is, as best seen in FIG. 9, when outer door 12 is in its closed position, latch member 76 engages latching member 78 to maintain outer door 12 in its closed position. As seen in FIG. 10, to disengage latch member 76 from latching member 78, a user depresses inward on latching button 70 which in turn pushes latch member 76 a sufficient distance to unlatch latch member 76 from latch member 78. Once latching button 70 has been depressed a sufficient distance, outer door 12 can be opened.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A security override system for a lockable enclosure comprising:

a hasp portion connected to a bracket slideably mounted within a locked enclosure, said hasp portion extending through a first opening in an outer door of said enclosure;

said bracket being movable between a closed position, wherein said hasp portion mates with said first opening to form a padlock receiving portion, and an open position, wherein a locked padlock in said padlock receiving portion can be removed without first unlocking said padlock;

a cam attached to said box and controllable from outside said enclosure;

said cam being positioned and dimensioned to cooperate with a corresponding cutout in said bracket such that said bracket is movable between said open position and said closed position by turning said cam member within said cutout.

2. The security override system according to claim 1, wherein said cutout is shaped generally as a quarter-circle.

3. The security override system according to claim 1, wherein said cam is shaped as a generally elongated oval and comprises a pushing portion at one end thereof.

4. The security override system according to claim 1, wherein said cam is controlled by a KS/216 screw.

5. The security override system according to claim 1, wherein said bracket comprises a cutout to accept a corresponding guide bolt mounted to said outer door for supportedly guiding the movement of said bracket.

6. The security override system according to claim 1, further comprising a biasing member attached to said cam.

7. The security override system according to claim 6, wherein said biasing member is a spring.

8. The security override system according to claim 6, wherein said biasing member biases said bracket in both said open position and said closed position.

9. The security override system according to claim 1, wherein said hasp portion is generally U-shaped.

10. The security override system according to claim 1, wherein said enclosure is a Building Entrance Protector.

11. The security override system according to claim 1, wherein said enclosure is a wiring junction box.

12. The security override system according to claim 1, wherein said enclosure is a network interface unit.

13. The security override system according to claim 1, further comprising a latching button mounted through a second opening in a side wall of said enclosure.

14. The security override system according to claim 13, wherein said outer door has an outer door latching member designed and positioned to correspond with a sidewall latching member attached to said side wall so as to maintain said outer door in a closed position.

15. The security override system according to claim 14, wherein said latching button is movable so as to disengage said outer door latching member from said side wall latching member to thereby open said outer door.

16. A building entrance protector (BEP) with a security override system comprising:

an outer door;

a hasp portion connected to a bracket;

said bracket slideably mounted within said BEP such that said hasp portion extends through an opening in said outer door;

said bracket being movable between a closed position wherein said hasp portion mates with said opening to form a padlock receiving section, and an open position wherein said hasp portion does not mate with said opening;

a cam attached to said BEP and controllable from outside said BEP; and said cam being positioned and dimensioned to cooperate with a corresponding cutout in said bracket such that said bracket is movable between said open position and said closed position by turning said cam within said cutout.

17. A security override system mounted to a lockable container comprising:

a bracket having a cuttout therein, said bracket being mounted within an interior portion of said container;

a cam dimensioned and positioned to cooperate with said cuttout;

said bracket being movable between a first position and a second position by turning said cam within said cuttout;

said cam being turnable from outside said container;

wherein said bracket futher comprises a hasp portion at one end thereof, said hasp portion forming a lock receiving portion when said bracket is in said first position, wherein a locked padlock inserted within said lock receiving portion prevents said container from being opened.

18. A security override system according to claim 17, wherein said container is operable when said bracket is in said second position without first unlocking said locked padlock.

* * * * *